US007082860B2

(12) United States Patent
Shu-Sui et al.

(10) Patent No.: US 7,082,860 B2
(45) Date of Patent: Aug. 1, 2006

(54) TANG AND RATCHET WRENCH WITH ROTATING DISC OPERATED DIRECTION CHANGE OF DRIVE AND RATCHETING

(75) Inventors: Lin Shu-Sui, Taichung (TW); Li Wan-Chuan, No. 1, Alley 49, Lane23, Yi Chang E. Rd., Tai-Pin City, Taichung (TW)

(73) Assignees: A.A.G. Industrial Co., LTD, Taichung (TW); Li Wan-Chuan, Taichung (TW)

( * ) Notice: Subject to any disclaimer, the term of this patent is extended or adjusted under 35 U.S.C. 154(b) by 97 days.

(21) Appl. No.: 10/956,932

(22) Filed: Sep. 30, 2004

(65) Prior Publication Data

US 2006/0065081 A1 Mar. 30, 2006

(51) Int. Cl.
*B25B 13/46* (2006.01)

(52) U.S. Cl. ..... 81/63.1; 81/60

(58) Field of Classification Search ..... 81/63.1, 81/60, 58.4
See application file for complete search history.

(56) References Cited

U.S. PATENT DOCUMENTS

| | | | | |
|---|---|---|---|---|
| 2,193,984 | A * | 3/1940 | Rhinevault | 192/43.2 |
| 3,290,969 | A * | 12/1966 | Bergquist et al. | 81/63.1 |
| 4,807,500 | A * | 2/1989 | Main | 81/63.1 |
| 6,047,802 | A * | 4/2000 | Huang | 192/43.2 |
| 6,227,077 | B1 * | 5/2001 | Chiang | 81/63.1 |
| 6,279,428 | B1 * | 8/2001 | Huang | 81/63.1 |
| 6,925,912 | B1 * | 8/2005 | Huang | 81/62 |

* cited by examiner

*Primary Examiner*—David B. Thomas
*Assistant Examiner*—Robert Scruggs
(74) *Attorney, Agent, or Firm*—W. Wayne Liauh

(57) ABSTRACT

Provided is a tang and ratchet wrench combination comprises drive teeth around an interior surface of an enclosed box portion, a rotatable drive mechanism in the box portion and having a square drive tang, a rotating disc having a shaft in the drive mechanism, and two spaced reversing pawls in cavities of the drive mechanism adapted to releasably engage with both the shaft and the drive teeth. Rotating the handle will pivot the reversing pawls for driving and ratcheting. Also, rotating the rotating disc will move a spring depressible detent from a first positioning tooth to a second one for changing direction of drive and ratcheting.

2 Claims, 14 Drawing Sheets

TANG AND RATCHET WRENCH WITH ROTATING DISC OPERATED DIRECTION CHANGE OF DRIVE AND RATCHETING

FIELD OF THE INVENTION

The present invention relates to ratchet wrenches and more particularly to a tang and ratchet wrench combination with a top rotating disc which is operative to change direction of drive and ratcheting.

BACKGROUND OF THE INVENTION

A conventional tang and ratchet wrench is shown in FIG. 1. As shown, an enclosed box portion 101 is provided in the wrench head integrally formed with a handle 10. A drive gear 11 is provided in the box portion 101. The drive gear 11 comprises a tang 111 extended downwardly, a top rotating disc 112, and an external drive teeth 113 provided between the tang 111 and the rotating disc 112. A larger circular portion 102 overlapping a smaller circular portion are provided recessed into an edge of the box portion 101 and are in communication therewith. A reversing pawl 12 having pawl teeth along an outer side and a detent notch on an inner side is provided in the larger circular portion 102. A spring biased rod 13 is anchored in an aperture (not shown) in the wrench head and is biased against the detent notch of the reversing pawl 12. A reversing lever 14 is projected from a cover plate located on top of the wrench head and is adapted to control the pivoting of the reversing pawl 12 for switching directions between driving (i.e., force exerted upon a workpiece by the handle 10) and ratcheting of the workpiece. As shown in FIG. 2, after loosening a workpiece by counterclockwise turning the handle 10, a user may turn the rotating disc 112 to rotate the tang 111 for removing the workpiece quickly rather than turning the handle 10 clockwise and counterclockwise alternately. However, the ratchet wrench is bulky due to the provision of the reversing pawl 12 and the reversing lever 14 both at one side of the drive gear 11.

Another conventional tang and ratchet wrench having reduced size as an improvement of the above tang and ratchet wrench is shown in FIGS. 3 to 6. As shown, an enclosed box portion 201 having drive teeth 202 around its interior surface is provided at the wrench head integrally formed with a handle 20. A drive gear 21 is provided in the box portion 201. The drive gear 21 comprises a tang 211 extended downwardly, a top rotating disc 212 having a knurled annular edge, a recess 213 provided between the tang 211 and the rotating disc 212. A reversing pawl 22, having two spaced pawl tooth sections on one side and a detent notch on the other side, is pivotably provided in the recess 213 by a vertical shaft 25 inserted through the rotating disc 212 and the reversing pawl 22 into a bottom of the recess 213. A pivotal knob 24 disposed on the drive gear 21 and a spring biased rod 23 biased between a downward shaft of the knob 24 and the notch of the reversing pawl 22 together are adapted to control the pivoting of the reversing pawl 22 for switching directions 11 between drive and ratcheting. As shown in FIG. 4 specifically, the right pawl teeth 222 of the reversing pawl 22 matingly engage with the teeth 202 and the left pawl teeth 221 thereof are disengaged from the teeth 202 because the notch of the reversing pawl 22 is biased by the rod 23 in a process of loosening a workpiece by counterclockwise turning the handle 20. At this position, there is no space available for turning the drive gear 21 counterclockwise further because the side adjacent the left pawl teeth 221 is engaged with a wall of the recess

213. As a result, the drive gear 21 rotates counterclockwise. As shown in FIG. 5 specifically, after the workpiece has been loosened, the handle 20 is motionless. The right pawl teeth 222 are urged by the teeth 202 to retract inwardly when the rotating disc 212 turns counterclockwise. As such, a user may rotate the rotating disc 212 counterclockwise to quickly remove the workpiece.

As shown in FIG. 6 specifically, for switching the direction of drive and ratcheting, it is required to turn knob 24 counterclockwise for matingly engaging the left pawl teeth 221 with the teeth 202. The counterclockwise rotation of the knob 24 is the same as that of the drive gear 21. However, such counterclockwise rotation of the knob 24 for overcoming the elastic force of the rod 23 may also rotate the drive gear 21. As a result, the desired direction change of drive and ratcheting is not possible. For solving this problem, the user has to use the other hand to hold the rotating disc 212 or the tang 211 for fixing the drive gear 21 to prevent its rotation when turning the knob 24 counterclockwise. As an end, the purpose of turning the knob 24 and the drive gear 21 in the same direction for direction change of drive and ratcheting can be achieved. However, such tang and ratchet wrench also has the problem of inconvenience in use despite its reduced size. Thus, the need for improvement still exists.

SUMMARY OF THE INVENTION

It is an object of the present invention to provide a tang and ratchet wrench combination comprising a handle including an enclosed box portion in one end having drive teeth around its interior surface; a rotatable drive mechanism provided in the box portion and including spaced first and second cavities on its top, a member between the first and the second cavities, a channel disposed between and being in communication with the first and second cavities, a spring depressible detent anchored in a central portion of a wall of the channel, first and second springs anchored at both sides of the detent, and a square drive tang extended downwardly; a rotating disc comprising a lower shaft disposed in the channel, first and second recesses formed on both sides of the shaft and first and second teeth provided on one side of the shaft between the first and the second recesses with the detent being resiliently received in the first teeth in a predetermined position; a first reversing pawl provided in the first cavity and comprising first pawl teeth, a first detent notch urged by the first spring, a first wall abutted one side of the member, and a first ridge between the first detent notch and the first wall and confined in the first recess; and a second reversing pawl provided in the second cavity and comprising second pawl teeth, a second detent notch urged by the second spring, a second wall abutted the other side of the member, and a second ridge between the second detent notch and the second wall and confined in the second recess; whereby: counterclockwise rotating the handle will urge the first ridge by the first recess, cause the first reversing pawl to compress the first spring, disengage the first pawl teeth from the drive teeth, disengage the second ridge from the second recess, expand the second spring, engage the second pawl teeth with the drive teeth, and rotate the drive mechanism counterclockwise for loosening a workpiece; immediately clockwise rotating the handle will cause the drive teeth to clockwise rotate the engaged second pawl teeth, compress the first spring, disengage the second wall from the other side of the member, and disengage the drive mechanism from the first reversing pawl for disposing the drive mechanism in a neutral position; counterclockwise rotating the rotating disc will urge the first ridge by the first recess, compress the first spring, disengage the first pawl teeth from the drive teeth, disengage the second ridge from the second recess, expand the second spring to engage the second pawl teeth with the drive teeth, and counterclockwise rotate the drive mechanism for further loosening the workpiece; and continuously clockwise rotating the rotating disc will cause the first recess to urge against the first ridge, cause the first reversing pawl to compress the first spring, disengage the second pawl teeth from the drive teeth, disengage the first reversing pawl from the first recess with the first spring being compressed, and move the detent from the first tooth to the second tooth for changing direction of drive and ratcheting.

The above and other objects, features and advantages of the present invention will become apparent from the following detailed description taken with the accompanying drawings.

DETAILED DESCRIPTION OF THE PREFERRED EMBODIMENTS

Figure 1:
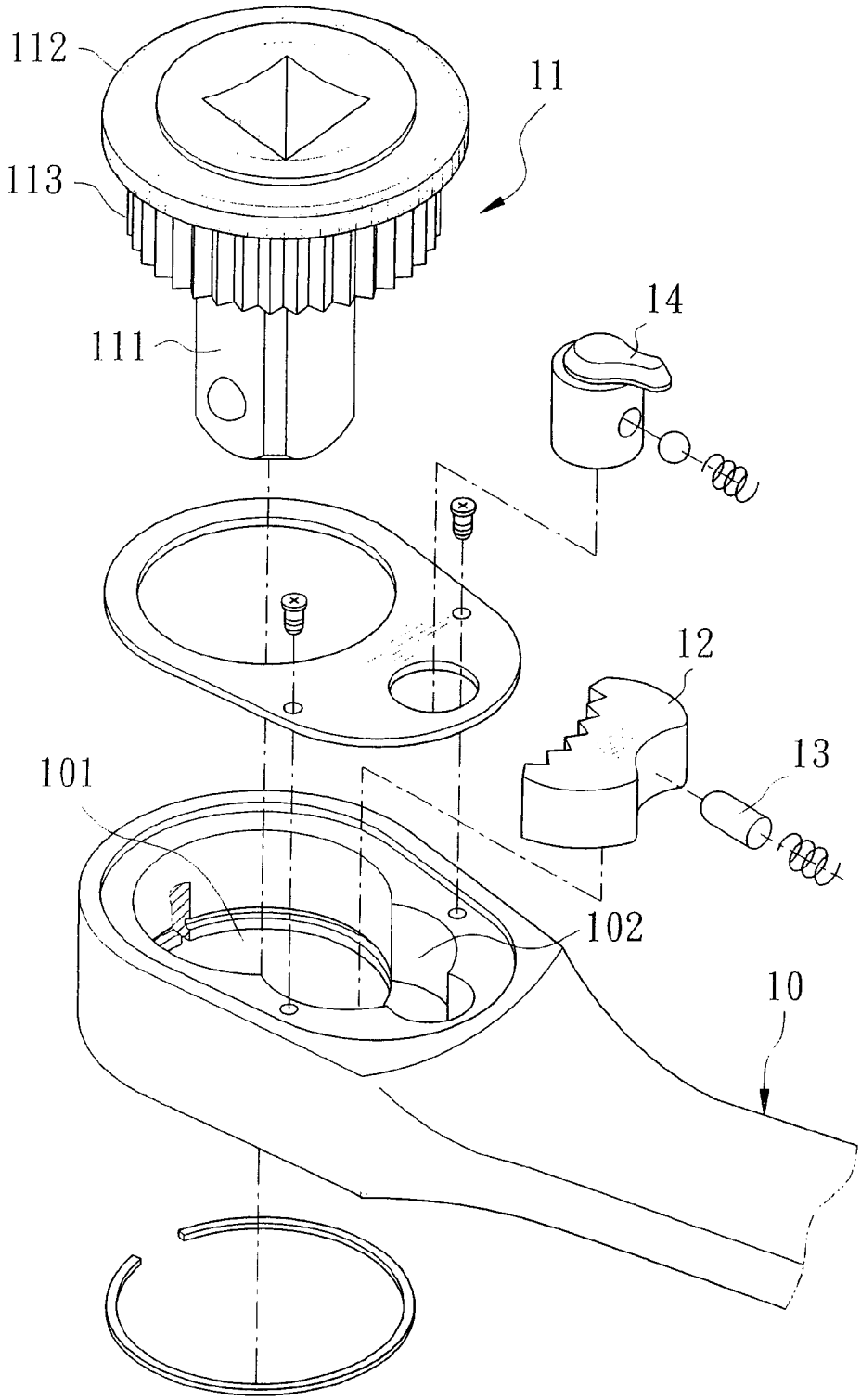
F I G . 1 PRIOR ART
FIG. 1 is an exploded view of a conventional tang and ratchet wrench.
Figure 2:
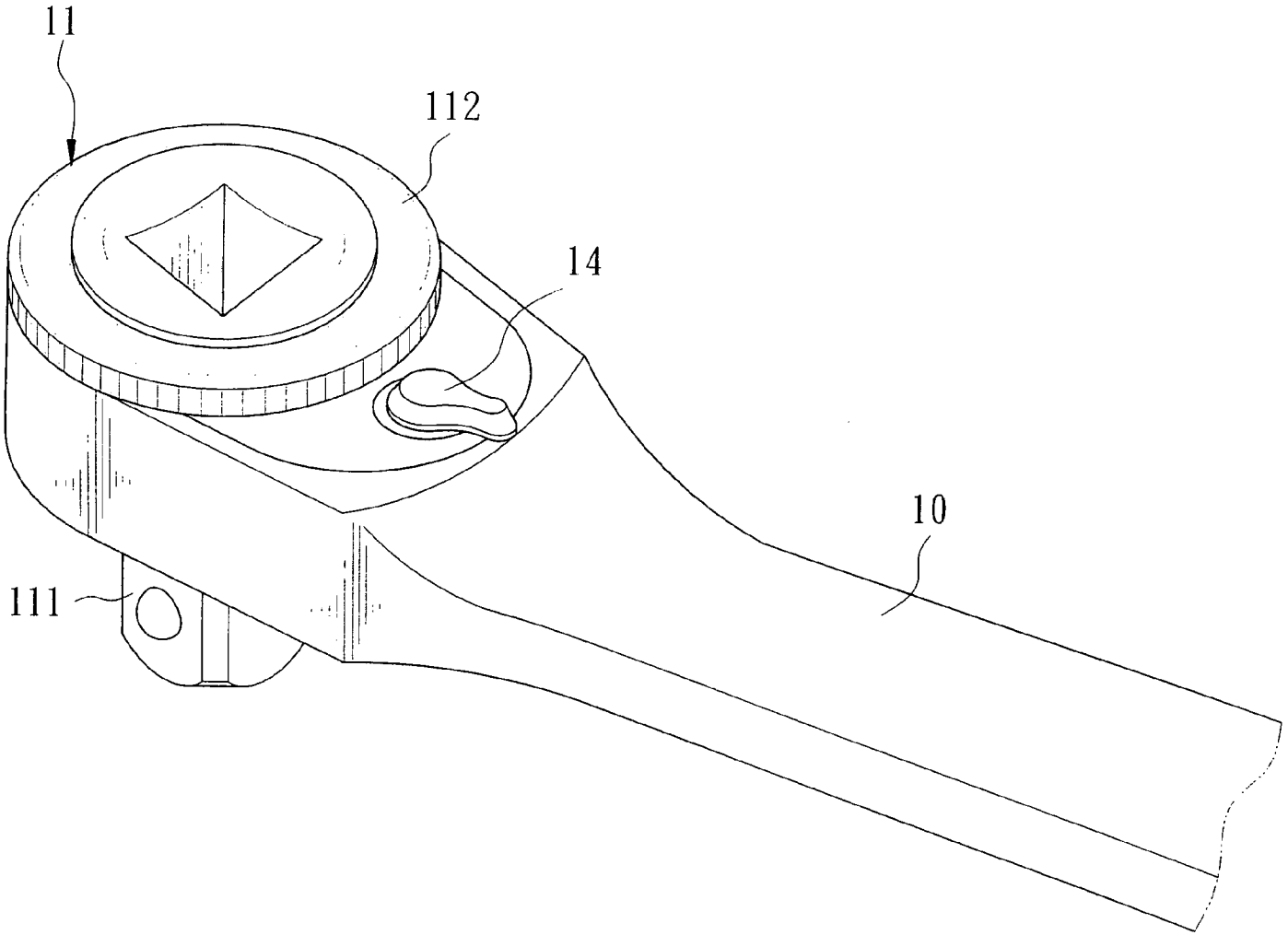
FIG. 2 PRIOR ART
FIG. 2 is a perspective view of the assembled wrench of FIG. 1.
Figure 3:
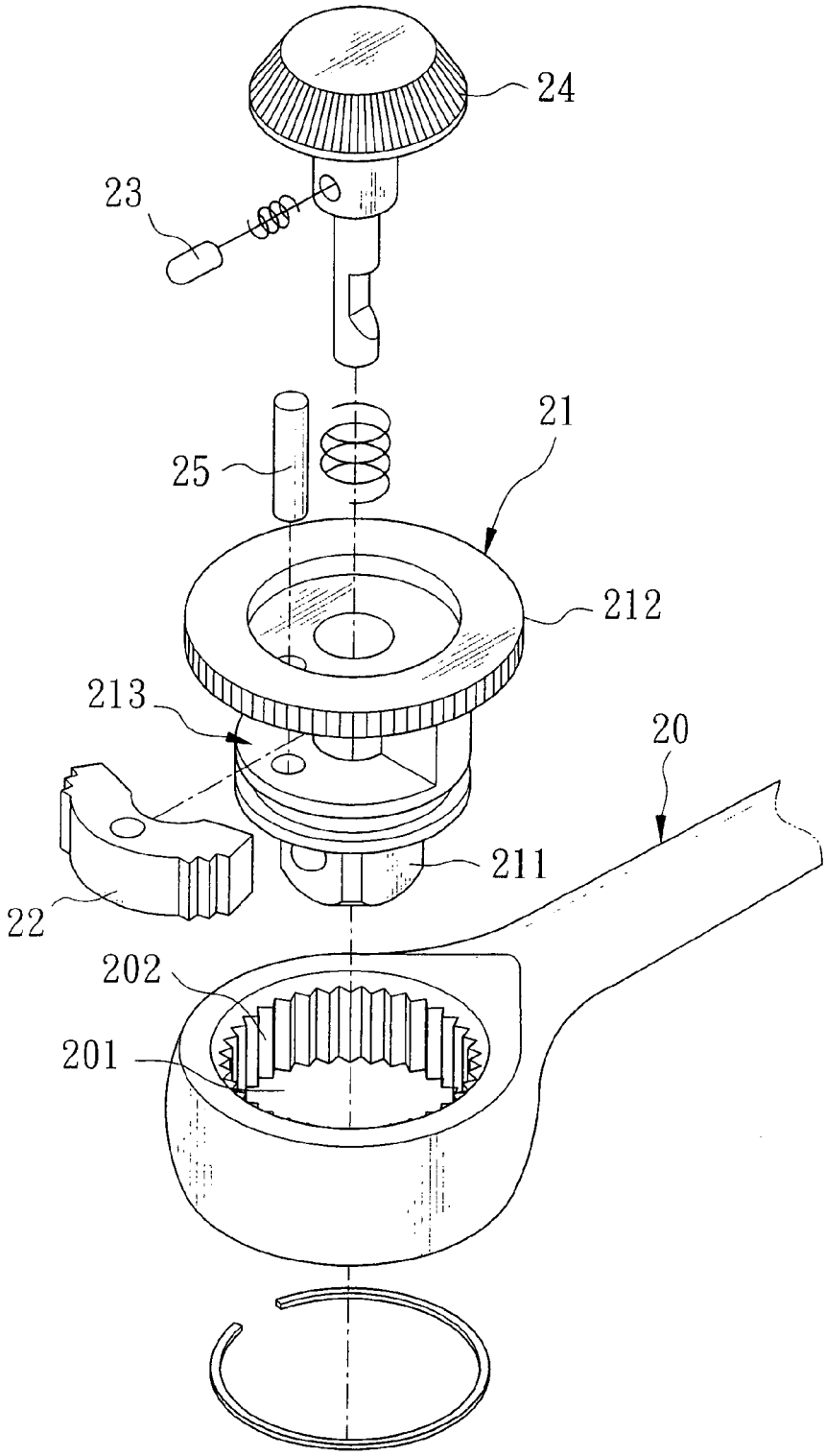
F I G . 3 PRIOR ART
FIG. 3 is an exploded view of another conventional tang and ratchet wrench.
Figure 4:
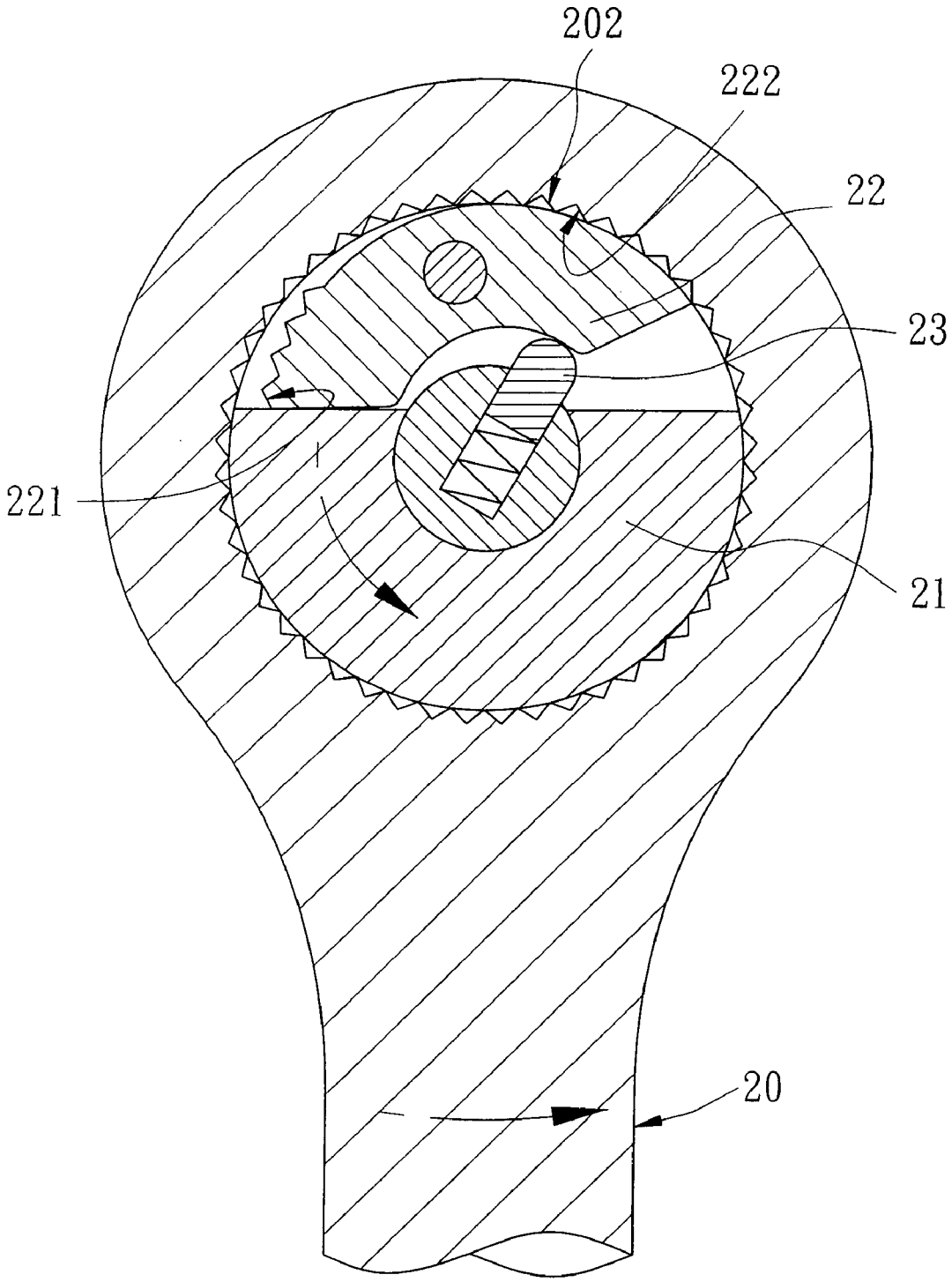
F I G . 4 PRIOR ART
FIG. 4 is a sectional view of the assembled wrench of FIG. 3 for illustrating a turning of workpiece by rotating the handle.
Figure 5:
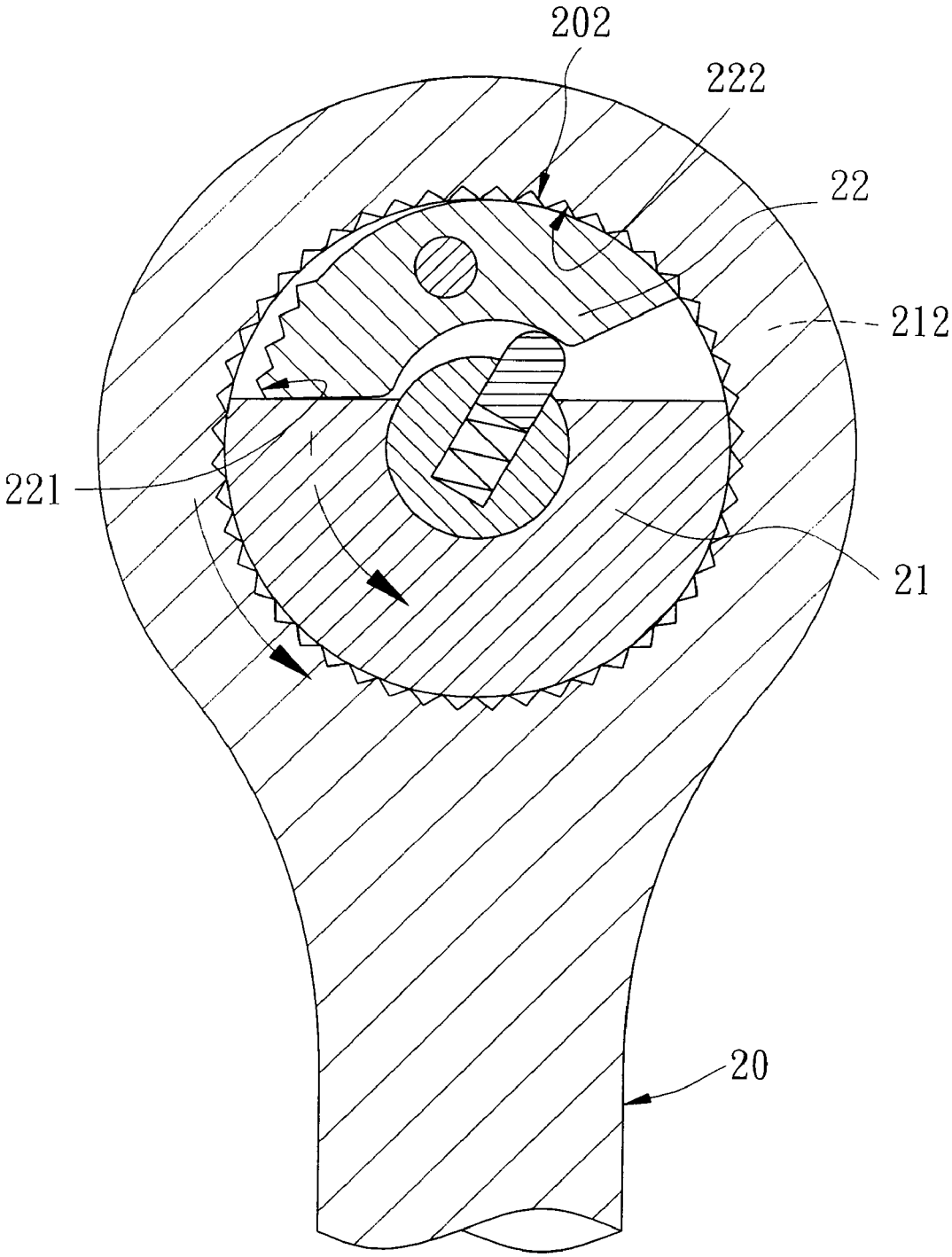
F I G . 5 PRIOR ART
FIG. 5 is a view similar to FIG. 4 for illustrating a turning of the rotating disc.
Figure 6:
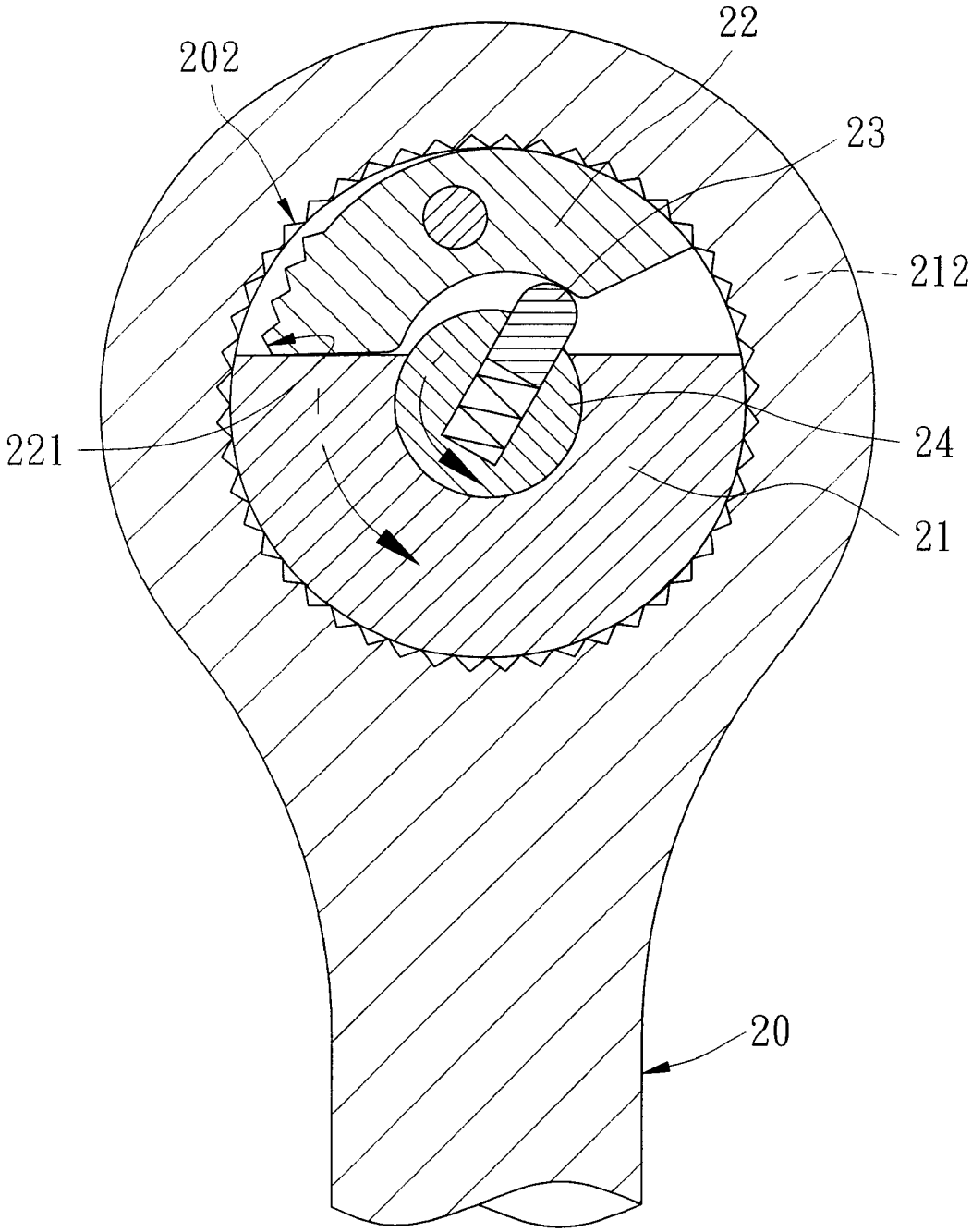
F I G . 6 PRIOR ART
FIG. 6 is a view similar to FIG. 4 for illustrating an operation of changing the direction of drive and ratcheting.
Figure 7:
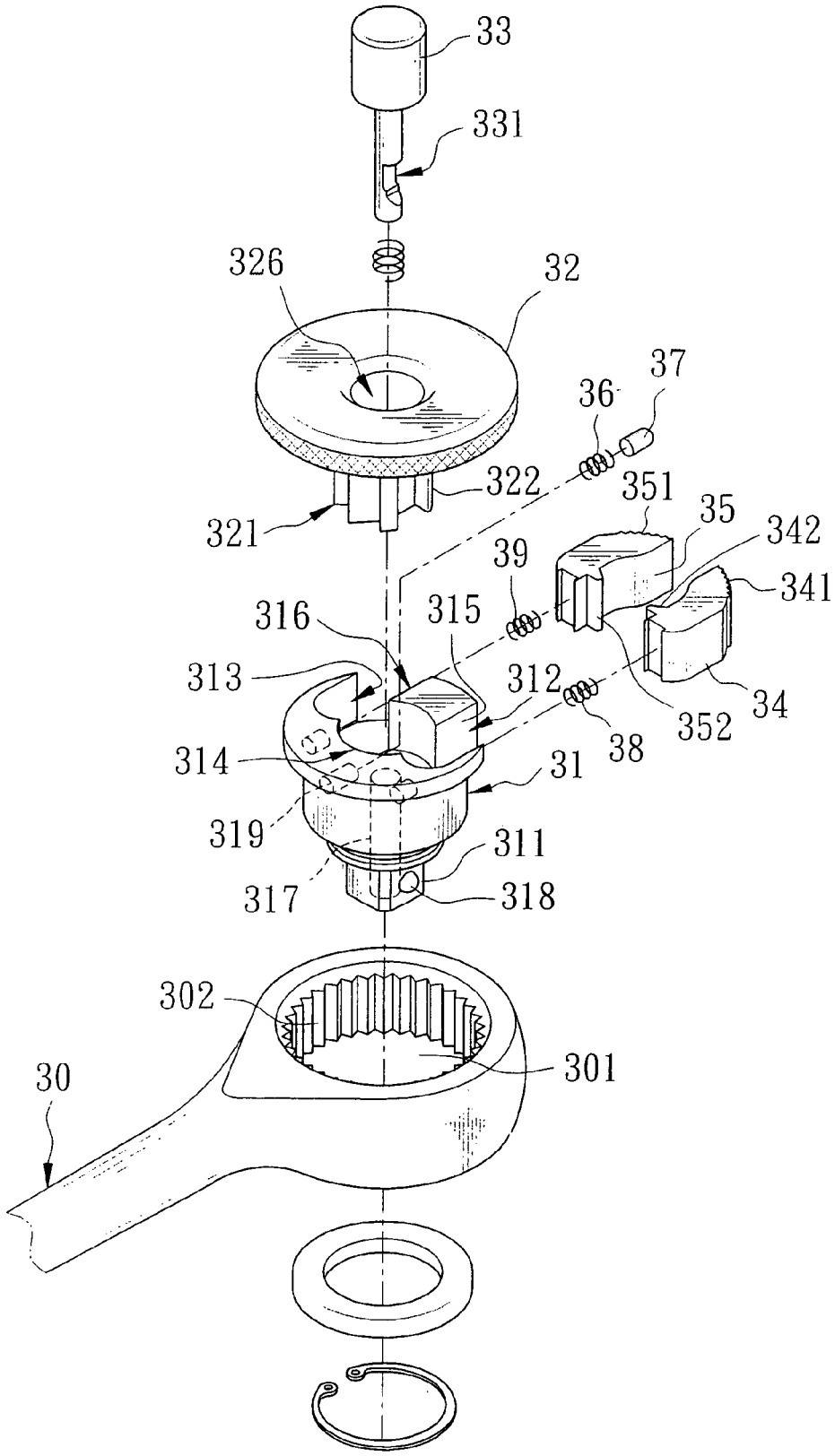
FIG. 7 is an exploded view of a preferred embodiment of tang and ratchet wrench according to the invention.
Figure 8:
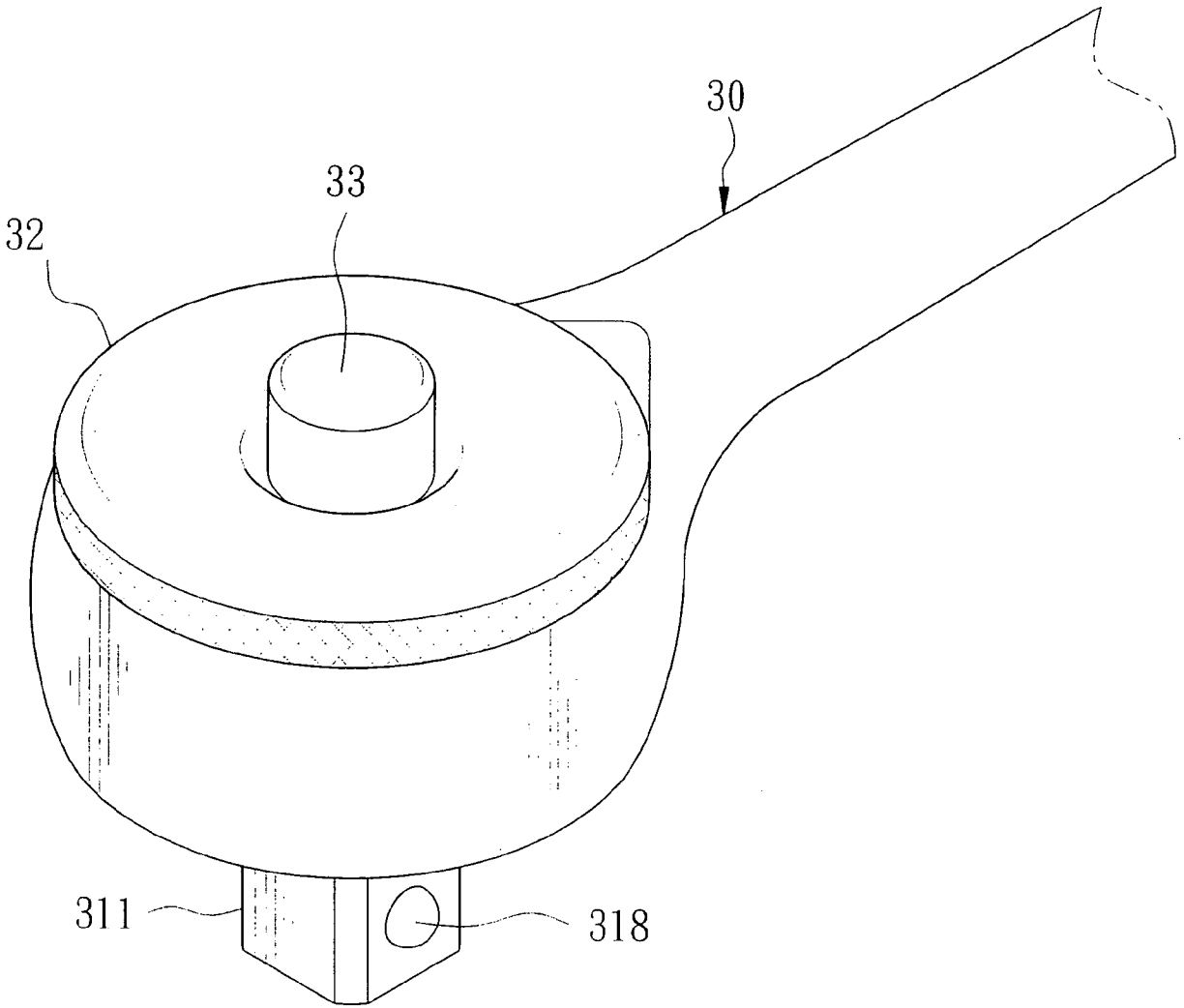
FIG. 8 is a perspective view of the assembled wrench of FIG. 7.
Figure 9:
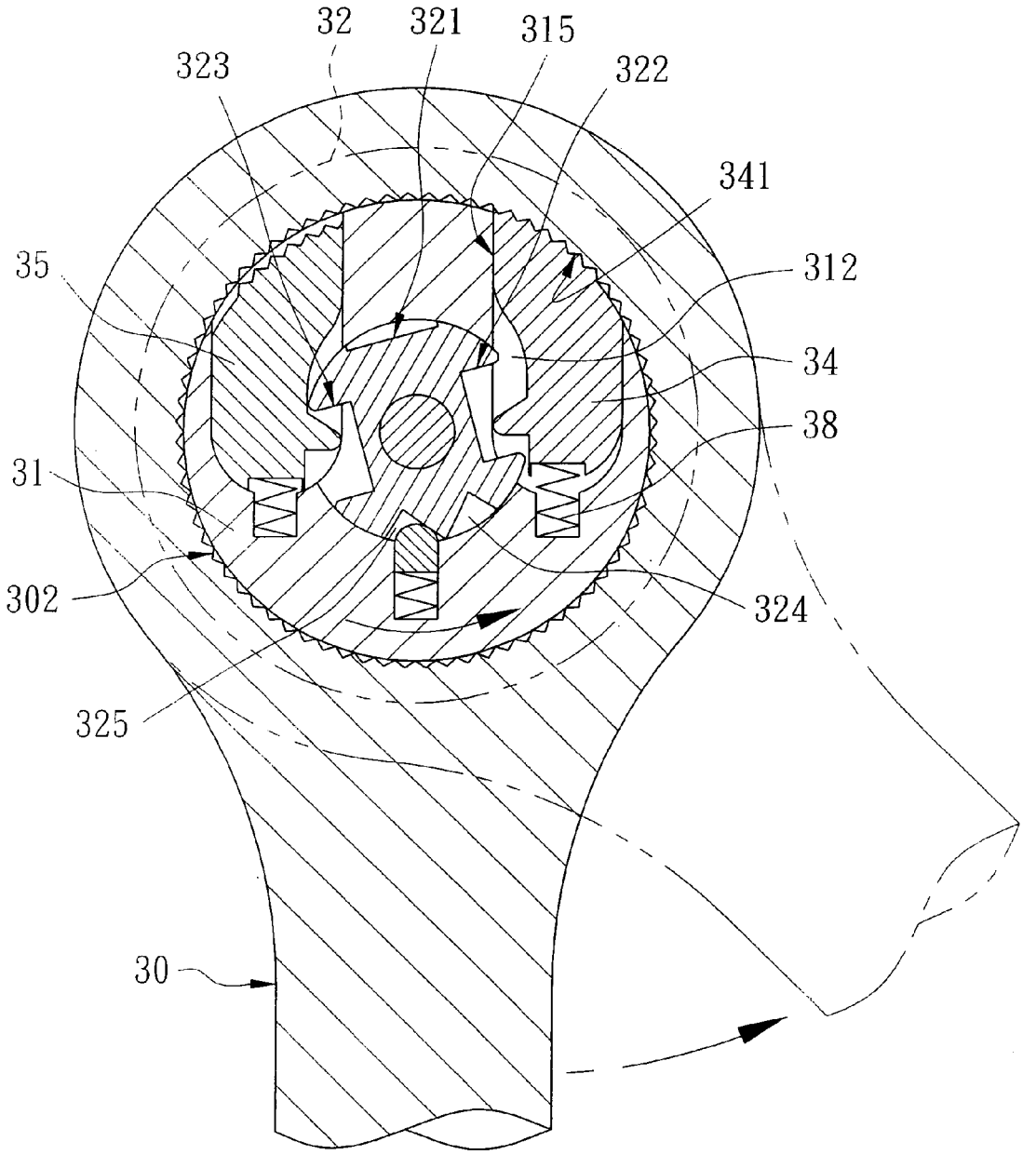
FIG. 9 is a sectional view of the wrench of FIG. 8 for illustrating a turning of workpiece by counterclockwise rotating the handle.

Referring to FIGS. 7, 8 and 9, there is shown a tang and ratchet wrench combination constructed in accordance with a preferred embodiment of the invention. As shown, an enclosed box portion 301 having drive teeth 302 around its interior surface is provided in the wrench head integrally formed with a handle 30. A rotatable drive mechanism 31 is provided in the box portion 301. The drive mechanism 31 comprises two spaced first and second cavities 312 and 313 on top, a member having a right surface 315 abutted the first cavity 312 and a left surface 316 abutted the second cavity 313, a channel 314 interconnected the first and second cavities 312 and 313, a square drive tang 311 extended downwardly from bottom, a vertical hole 317 extended from a bottom of the channel 314 to a bottom of the tang 311, a spring depressible ball 318 is anchored on a side dent of the tang 311, three apertures 319 recessed into a wall of the channel 314, a spring 36 and a detent 37 having a half circular head both provided in one aperture 319, and springs 38 and 39 anchored in the other two apertures 319.

A rotating disc 32 comprises a shaft 321 extended downwardly into the channel 314, recesses 322 and 323 formed on both sides of the shaft 321, a central hole 326 through the top and the shaft 321, and first and second teeth 324 and 325 provided on one side of the shaft 321 between the recesses 322 and 323. A spring biased push rod 33 is provided in the holes 326 and 317 and comprises a well 331 on its shank. The ball 318 is adapted to retract into the well 331 for disengaging the tang 311 from a workpiece. The push rod 33 is a well known device. Thus, a detailed description thereof is omitted herein for the sake of brevity.

A first reversing pawl 34 is provided in the first cavity 312 and comprises pawl teeth 341 along an outer side, a detent notch on an inner side being urged by the spring 38, and a ridge 342 between the notch and the teeth 341 confined in the recess 322. A portion of the inner side of the first reversing pawl 34 is abutted the right surface 315 in a non-operating position. The teeth 341 are adapted to releasably engage with the teeth 302. Similarly, a second reversing pawl 35 is provided in the first cavity 313 and comprises pawl teeth 351 along an outer side, a detent notch on an inner side being urged by the spring 39, and a ridge 352 between the notch and the teeth 351 confined in the recess 323. A portion of the inner side of the second reversing pawl 35 is abutted the left surface 316 in a non-operating position. The teeth 351 are adapted to releasably engage with the teeth 302. Also, a ring and a split ring are installed on a bottom of the wrench head in a manner known in the art.

Referring to FIG. 9 specifically, a workpiece loosening operation will be described in detailed below. First, counterclockwise rotate the handle 30 to urge the ridge 352 by the recess 323. As a result, the spring 39 is compressed by the second reversing pawl 35 and the pawl teeth 351 are disengaged from the teeth 302. To the contrary, the ridge 342 is disengaged from the recess 322. As a result, the spring 38 is expanded to matingly engage the pawl teeth 341 with the teeth 302. Moreover, the inner side of the second reversing pawl 35 is urged against the left surface 316 and the inner side of the first reversing pawl 34 is urged against the right surface 315. As such, the drive mechanism 31 rotates counterclockwise, resulting in a loosening of the workpiece.

Figure 10:
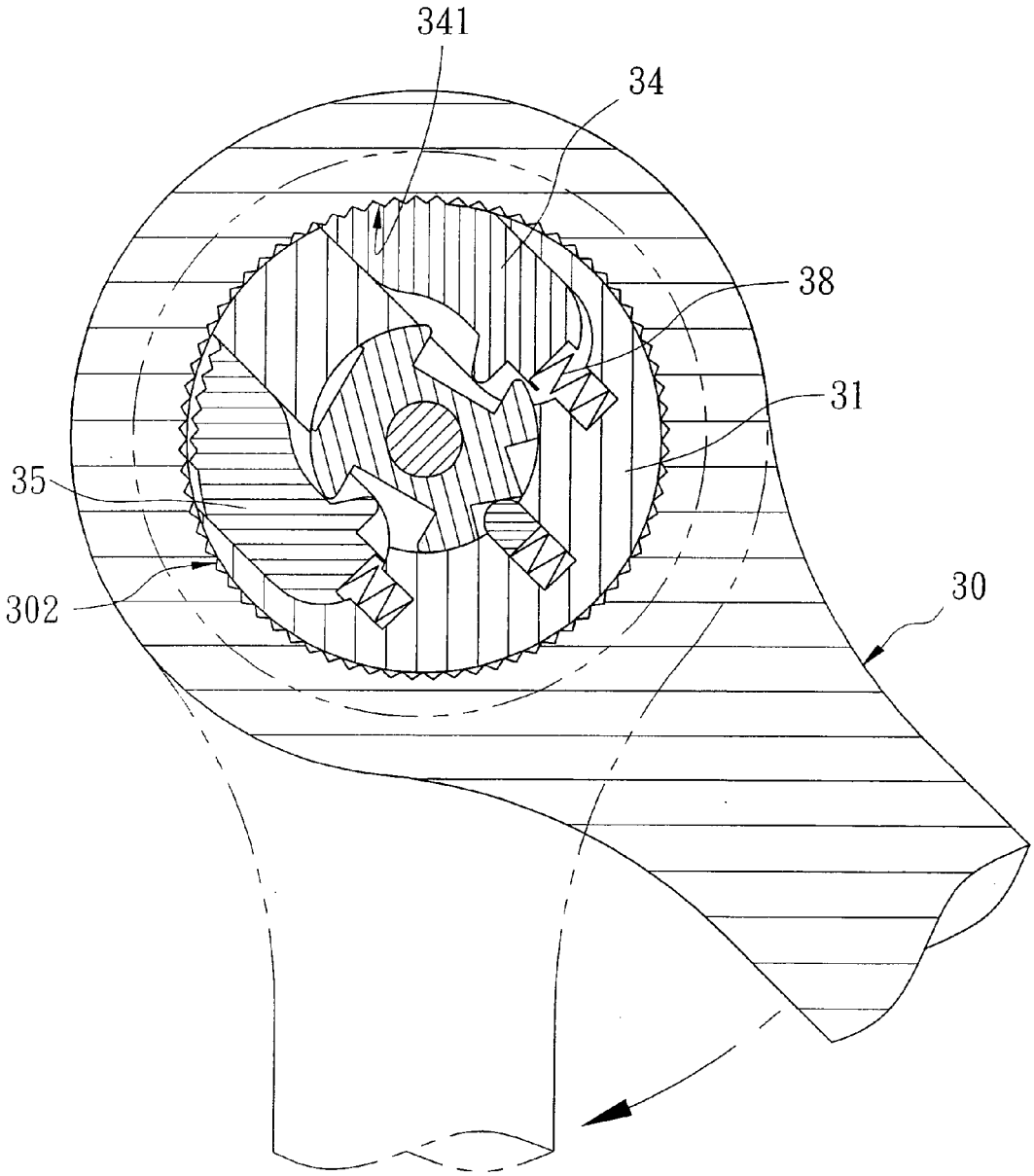
FIG. 10 is a view similar to FIG. 9 for illustrating a clockwise turning of the handle to substantially return to its original position with the drive mechanism motionless.

Referring to FIG. 10, a returning operation of the handle 30 will be described in detailed below. First, a clockwise rotation of the handle 30 will cause the teeth 302 to clockwise rotate the engaged pawl teeth 341, resulting in a compression of the spring 38. At this position, the inner side of the first reversing pawl 34 is disengaged from the right surface 315 and the ridge 342 is still disengaged from the recess 322. That is, the drive mechanism 31 is disengaged from the first reversing pawl 34. As an end, the drive mechanism 31 is neutral (i.e., motionless) so as to make an immediately next counterclockwise rotation of the handle 30 possible for loosening the workpiece.

Figure 11:
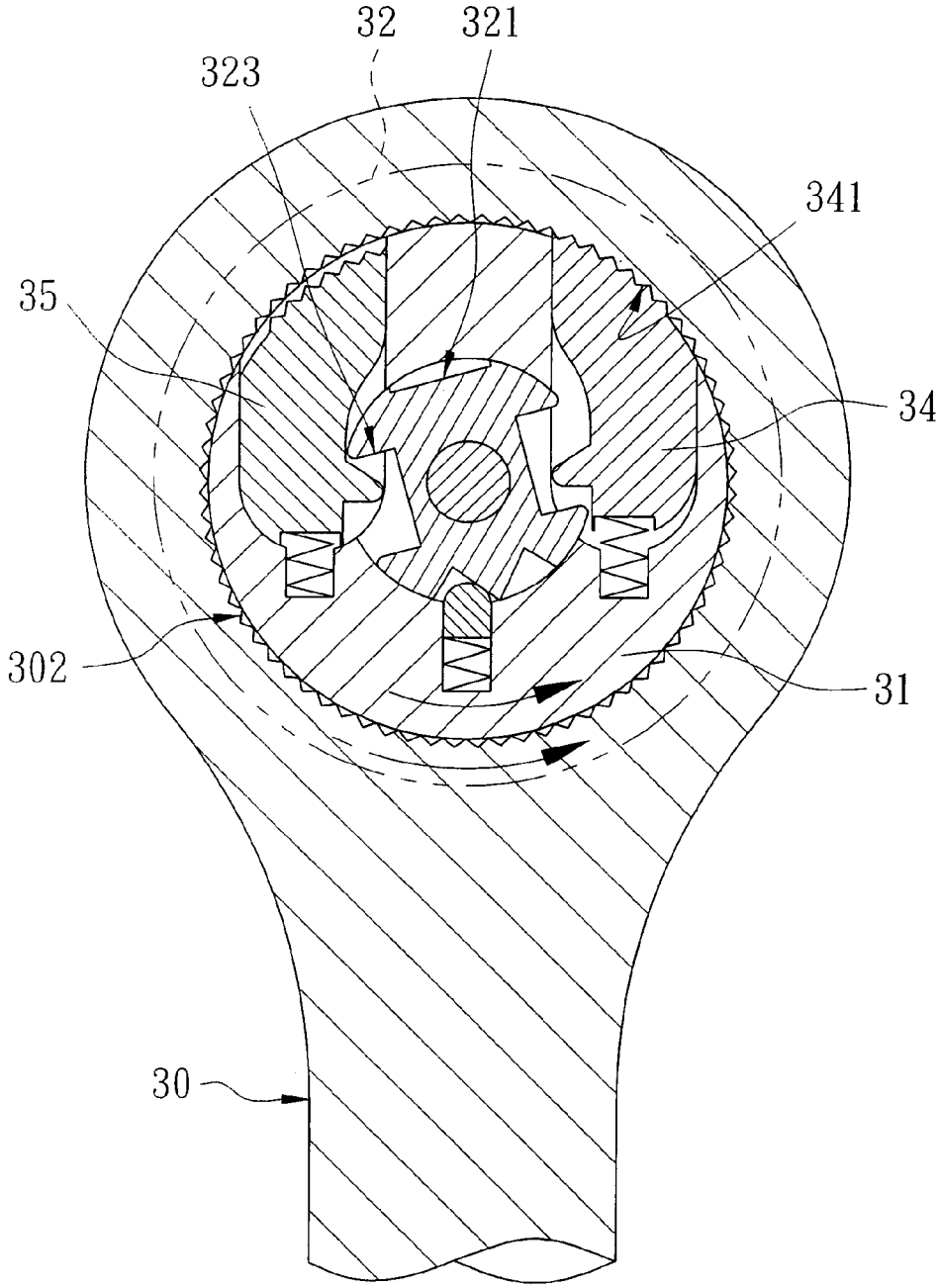
FIG. 11 is a view similar to FIG. 9 for illustrating a counterclockwise turning of the drive mechanism by counterclockwise turning the rotating disc.

Referring to FIG. 11, after initially loosening the workpiece a user may counterclockwise rotate the rotating disc 32 to loosen the workpiece quickly. The ridge 352 is urged by the recess 323 to compress the spring 39 and the pawl teeth 351 are thus disengaged from the teeth 302. This causes the workpiece coupled to the tang 311 to continue loosening. To the contrary, the ridge 342 is disengaged from the recess 322. As a result, the spring 38 is expanded to matingly engage the pawl teeth 341 with the teeth 302. Moreover, the inner side of the second reversing pawl 35 is urged against the left surface 316 and the inner side of the first reversing pawl 34 is urged against the right surface 315. As such, the drive mechanism 31 rotates counterclockwise, resulting in a further loosening of the workpiece.

Figure 12:
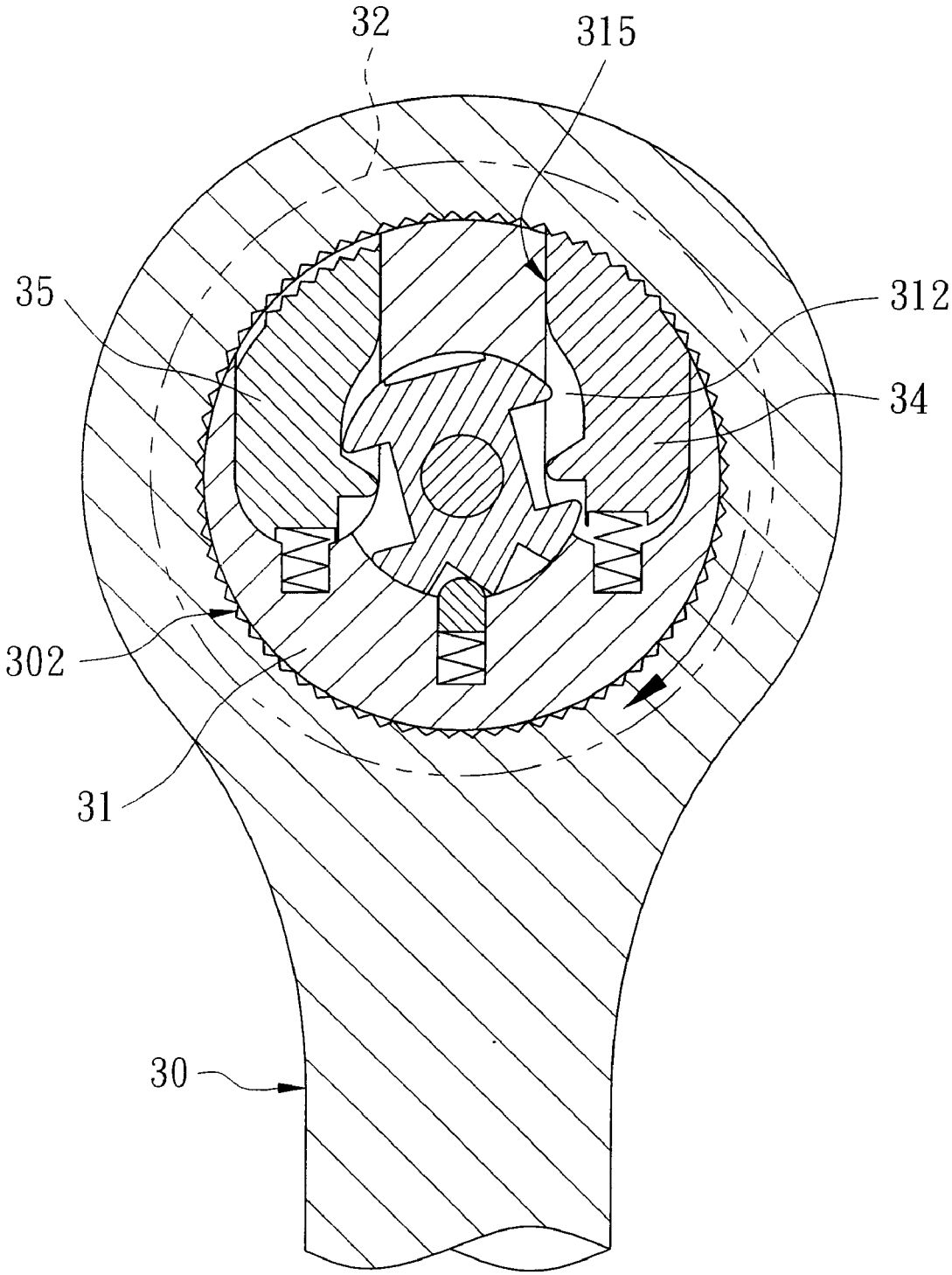
FIG. 12 is a view similar to FIG. 10 for illustrating a clockwise turning of the rotating disc to substantially return to its original position with the drive mechanism motionless.

Referring to FIG. 12, in the process of loosening the workpiece a clockwise rotation of the rotating disc 32 will inhibit the same clockwise rotation of the drive mechanism 31 because the teeth 302 are ratcheted. As such, the right surface 315 remains in contact with the inner side of the first reversing pawl 34. As a result, a clockwise rotation of the rotating disc 32 cannot clockwise rotate the drive mechanism 31 (i.e., the drive mechanism 31 is neutral).

Figure 13:
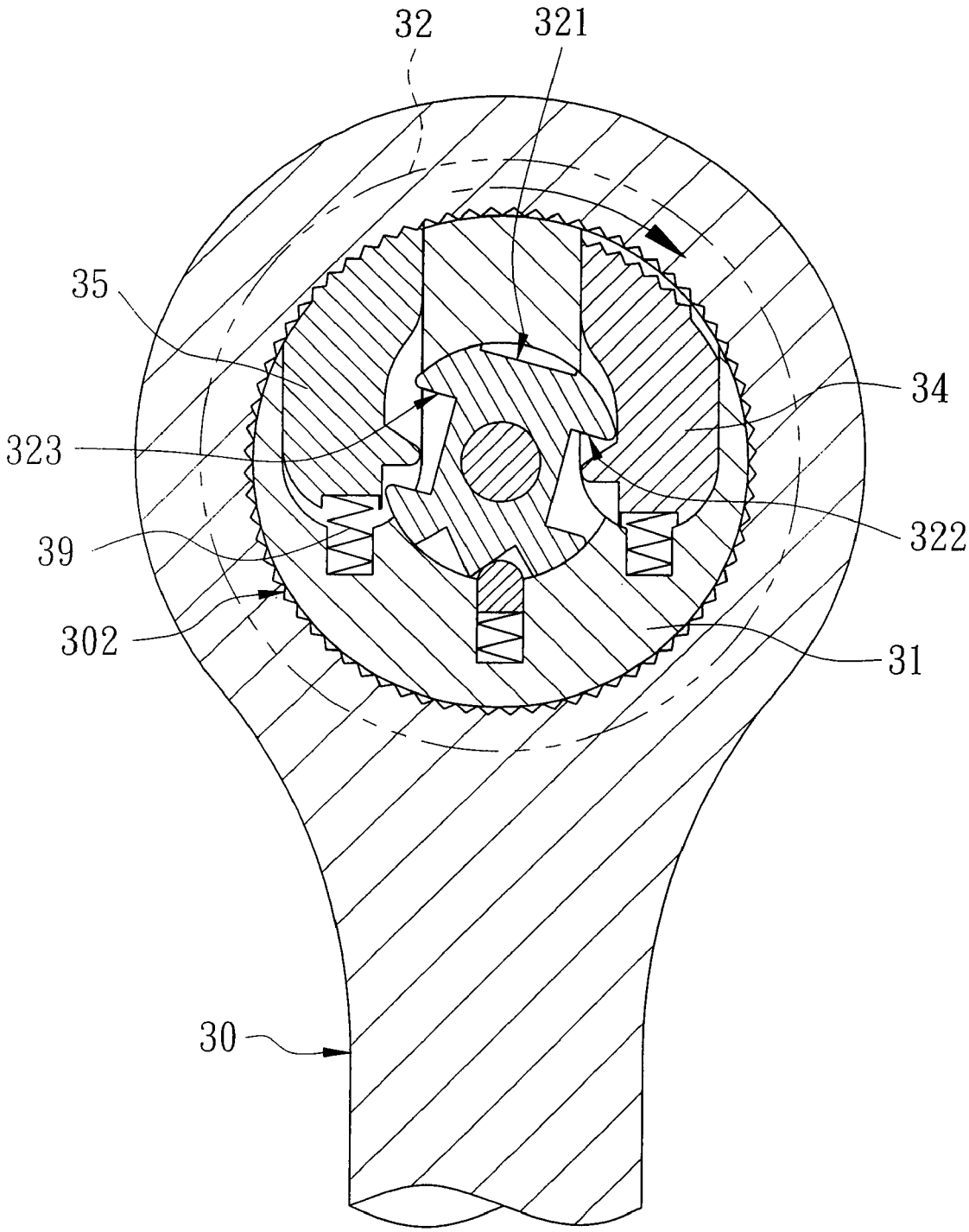
FIG. 13 is a view similar to FIG. 10 for illustrating an operation of changing the direction of drive and ratcheting by clockwise turning the rotating disc.

Referring to FIG. 13, an operation of changing the direction of drive and ratcheting will be described in detailed below. Continuously clockwise rotate the rotating disc 32, the drive mechanism 31 being still motionless (i.e., locked) will cause the recess 322 to urge against the ridge 342. And in turn, the first reversing pawl 34 compresses the spring 38 and the pawl teeth 341 are disengaged from the teeth 302. Also, the second reversing pawl 35 is disengaged from the recess 323 with the spring 39 being compressed. As a result, the spring biased detent 37 moves from the second tooth 325 shown in FIG. 9 to the first tooth 324 shown in FIG. 13. This finishes the direction change of drive and ratcheting by rotating the rotating disc 32 clockwise without holding the tang 311 with the other hand. Hence, the invention is more convenient in the above operation.

Figure 14:
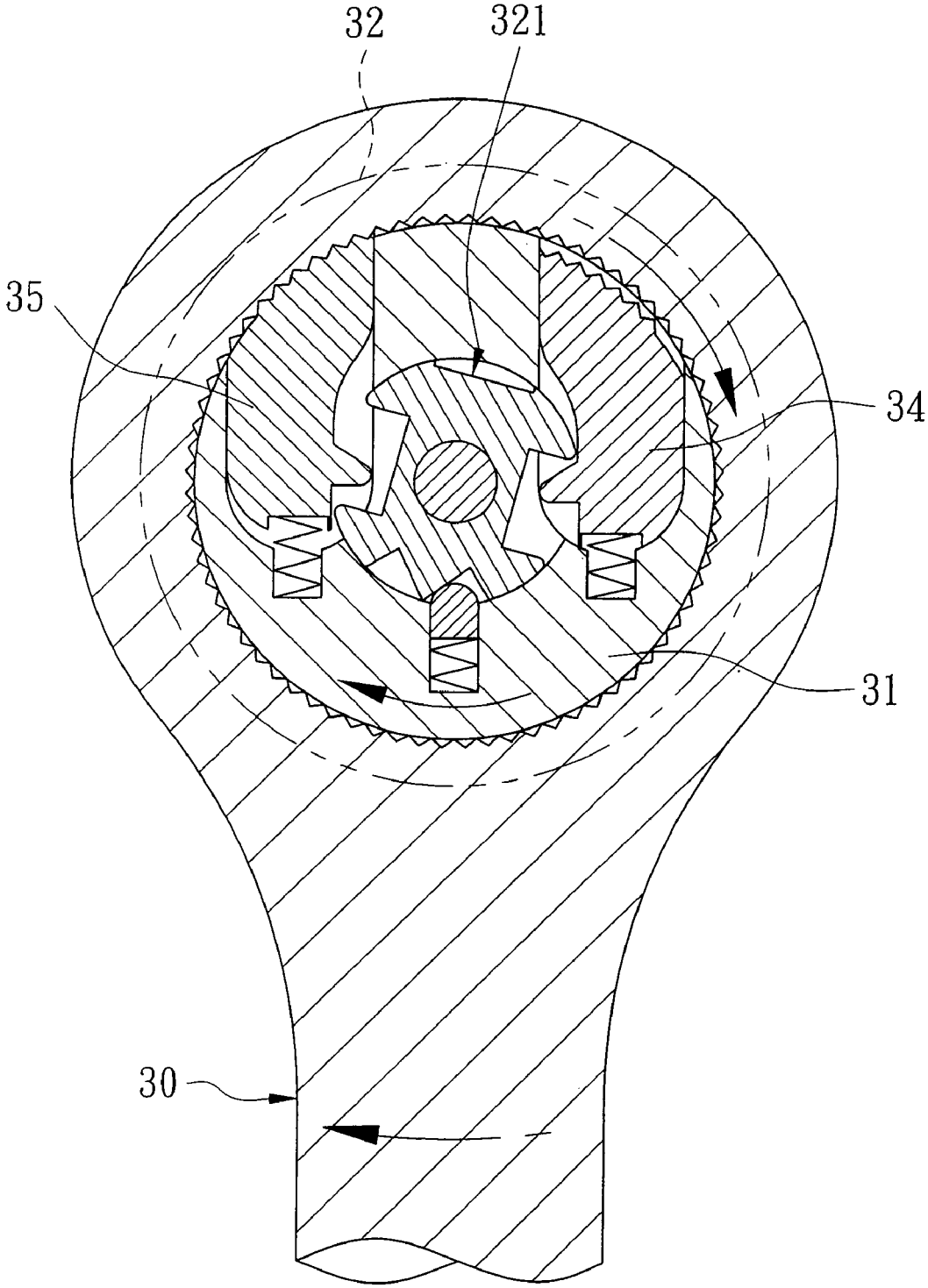
FIG. 14 is a view similar to FIG. 13 for illustrating fastening of a workpiece by clockwise rotating the wrench after changing the direction of drive and ratcheting.

Referring to FIG. 14, after finishing the operation of changing the direction of drive and ratcheting, a clockwise rotation of the handle 30 may cause the drive mechanism 31 to clockwise rotate. As a result, the workpiece is tightened (i.e., fastened). Also, a clockwise rotation of the rotating disc 32 may cause the drive mechanism 31 to quickly fasten the workpiece.

While the invention herein disclosed has been described by means of specific embodiments, numerous modifications and variations could be made thereto by those skilled in the art without departing from the scope and spirit of the invention set forth in the claims.

What is claimed is:

1. A tang and ratchet wrench combination comprising:

a handle including an enclosed box portion in one end having drive teeth around its interior surface;

a rotatable drive mechanism provided in the box portion and including spaced first and second cavities on its top, a member between the first and the second cavities, a channel disposed between and being in communication with the first and second cavities, a spring depressible detent anchored in a central portion of a wall of the channel, first and second springs anchored at both sides of the detent, and a square drive tang extended downwardly;

a rotating disc comprising a lower shaft disposed in the channel, first and second recesses formed on both sides of the shaft and first and second teeth provided on one side of the shaft between the first and the second recesses with the detent being resiliently received in the first teeth in a predetermined position;

a first reversing pawl provided in the first cavity and comprising first pawl teeth, a first detent notch urged by the first spring, a first wall abutted one side of the member, and a first ridge between the first detent notch and the first wall and confined in the first recess; and a second reversing pawl provided in the second cavity and comprising second pawl teeth, a second detent notch urged by the second spring, a second wall abutted the other side of the member, and a second ridge between the second detent notch and the second wall and confined in the second recess;

whereby:

counterclockwise rotating the handle will urge the first ridge by the first recess, cause the first reversing pawl to compress the first spring, disengage the first pawl teeth from the drive teeth, disengage the second ridge from the second recess, expand the second spring, engage the second pawl teeth with the drive teeth, and rotate the drive mechanism counterclockwise for loosening a workpiece;

immediately clockwise rotating the handle will cause the drive teeth to clockwise rotate the engaged second pawl teeth, compress the first spring, disengage the second wall from the other side of the member, and disengage the drive mechanism from the first reversing pawl for disposing the drive mechanism in a neutral position;

counterclockwise rotating the rotating disc will urge the first ridge by the first recess, compress the first spring, disengage the first pawl teeth from the drive teeth, disengage the second ridge from the second recess, expand the second spring to engage the second pawl teeth with the drive teeth, and counterclockwise rotate the drive mechanism for further loosening the workpiece; and continuously clockwise rotating the rotating disc will cause the first recess to urge against the first ridge, cause the first reversing pawl to compress the first spring, disengage the second pawl teeth from the drive teeth, disengage the first reversing pawl from the first recess with the first spring being compressed, and move the detent from the first tooth to the second tooth for changing direction of drive and ratcheting.

2. The tang and ratchet wrench combination of claim 1, wherein the drive mechanism further comprises a vertical hole extended from a bottom of the channel to a bottom of the tang, a spring depressible ball anchored on a side of the tang, and the rotating disc further comprises a a central hole through its top and the shaft, and a spring biased push rod provided in the central hole and the vertical hole and including a well on its shank such that the ball is adapted to retract into the well for disengaging a workpiece from the tang.

* * * * *